US007793473B2

(12) United States Patent
Sorkin

(10) Patent No.: US 7,793,473 B2
(45) Date of Patent: Sep. 14, 2010

(54) SHEATHING RETAINING CAP

(76) Inventor: Felix L. Sorkin, 13022 Trinity Dr., Stafford, TX (US) 77477

( * ) Notice: Subject to any disclaimer, the term of this patent is extended or adjusted under 35 U.S.C. 154(b) by 133 days.

(21) Appl. No.: 12/123,432

(22) Filed: May 19, 2008

(65) Prior Publication Data

US 2009/0077913 A1 Mar. 26, 2009

Related U.S. Application Data

(63) Continuation-in-part of application No. 12/100,066, filed on Apr. 9, 2008, which is a continuation-in-part of application No. 11/950,295, filed on Dec. 4, 2007, which is a continuation-in-part of application No. 11/933,041, filed on Oct. 31, 2007, and a continuation-in-part of application No. 11/933,029, filed on Oct. 31, 2007, said application No. 11/933,041 is a continuation-in-part of application No. 11/861,185, filed on Sep. 25, 2007, said application No. 11/933,029 is a continuation-in-part of application No. 11/861,185.

(51) Int. Cl.
*E04C 5/08* (2006.01)

(52) U.S. Cl. ..... 52/223.13; 403/314; 403/367; 403/369; 403/374.1; 24/122.6

(58) Field of Classification Search ..... 52/223.13; 403/304, 314, 365, 367, 368, 369, 374.1; 24/122.6, 122.3, 459, 136 R, 115 M See application file for complete search history.

(56) References Cited

U.S. PATENT DOCUMENTS

| | | | | | |
|---|---|---|---|---|---|
| 231,751 | A | * | 8/1880 | Bailey et al. | 403/368 |
| 274,796 | A | * | 3/1883 | Loehner | 403/314 |
| 833,548 | A | * | 10/1906 | Putnam | 403/368 |
| 1,646,660 | A | * | 10/1927 | Prince | 439/805 |
| 2,062,290 | A | * | 12/1936 | Bott | 384/536 |
| 2,166,458 | A | * | 7/1939 | Berndt et al. | 439/788 |
| 2,699,589 | A | * | 1/1955 | Redell | 294/102.1 |
| 2,834,081 | A | * | 5/1958 | Stump, Jr. | 403/369 |
| 2,930,642 | A | * | 3/1960 | Howlett | 403/314 |
| 3,163,904 | A | * | 1/1965 | Ziolkowski | 403/365 |

(Continued)

OTHER PUBLICATIONS

U.S. Appl. No. 11/861,185, filed Sep. 25, 2007.

(Continued)

*Primary Examiner*—Brian E Glessner
(74) *Attorney, Agent, or Firm*—Egbert Law Offices PLLC

(57) ABSTRACT

An article for engaging a sheathing of a sheathed portion of a tendon has a tubular body having an inner surface and outer surface and a first end and a second end, fins extending radially outwardly from the outer surface, a longitudinal split extending through a wall of the tubular body and extending from the first end to the second end, locking ribs extending radially inwardly from the inner surface of the tubular body, and a collar formed adjacent the second end of said tubular body. Each of the locking ribs extends parallel to the other locking ribs. The locking ribs are equally spaced along the inner surface of the tubular body. Each of the fins extends parallel to the other fins. Each of the fins have a height increasing from the first end to the second end of the tubular body.

19 Claims, 2 Drawing Sheets

U.S. PATENT DOCUMENTS

| | | | | | |
|---|---|---|---|---|---|
| 3,253,332 | A | * | 5/1966 | Howlett et al. | 29/506 |
| 3,534,989 | A | * | 10/1970 | Yonkers | 403/369 |
| 3,596,330 | A | * | 8/1971 | Scott et al. | 24/122.3 |
| 3,698,749 | A | * | 10/1972 | Yonkers | 403/197 |
| 3,912,406 | A | * | 10/1975 | McGrath | 403/19 |
| 4,146,951 | A | * | 4/1979 | Howlett | 29/452 |
| 4,271,917 | A | * | 6/1981 | Sahley | 175/426 |
| 4,494,890 | A | * | 1/1985 | Lusk | 403/267 |
| 4,619,088 | A | * | 10/1986 | Ripoll Garcia-Mansilla | 52/223.13 |
| 4,623,277 | A | * | 11/1986 | Wayne et al. | 403/314 |
| 5,141,356 | A | * | 8/1992 | Chaize | 403/368 |
| 5,374,135 | A | * | 12/1994 | Folsom et al. | 403/369 |
| 5,469,677 | A | * | 11/1995 | Luthi | 52/223.13 |
| 5,630,301 | A | * | 5/1997 | Sieg | 52/223.13 |
| 5,729,938 | A | * | 3/1998 | Tobias | 52/220.8 |
| 5,770,286 | A | | 6/1998 | Sorkin | |
| 5,839,235 | A | | 11/1998 | Sorkin | |
| 5,897,102 | A | * | 4/1999 | Sorkin | 254/29 A |
| 6,098,356 | A | | 8/2000 | Sorkin | |
| 6,151,850 | A | * | 11/2000 | Sorkin | 52/223.13 |
| 6,381,912 | B1 | | 5/2002 | Sorkin | |
| 6,631,596 | B1 | | 10/2003 | Sorkin | |
| 6,817,148 | B1 | | 11/2004 | Sorkin | |
| 2003/0159377 | A1 | * | 8/2003 | Marshall | 52/223.13 |
| 2003/0159395 | A1 | * | 8/2003 | Dahl | 52/726.1 |
| 2004/0148881 | A1 | * | 8/2004 | Hayes | 52/223.13 |

OTHER PUBLICATIONS

U.S. Appl. No. 11/874,087, filed Oct. 17, 2007.
U.S. Appl. No. 11/933,041, filed Oct. 31, 2007.
U.S. Appl. No. 11/933,029, filed Oct. 31, 2007.
U.S. Appl. No. 11/950,295, filed Dec. 4, 2007.
U.S. Appl. No. 12/100,066, filed Apr. 9, 2008.

* cited by examiner

SHEATHING RETAINING CAP

CROSS-REFERENCE TO RELATED APPLICATIONS

The present invention is a continuation-in-part of U.S. application Ser. No. 12/100,066, filed on Apr. 9, 2008, entitled "Sheathing Lock", presently pending. U.S. application Ser. No. 12/100,066 is a continuation-in-part of U.S. application Ser. No. 11/950,295, filed on Dec. 4, 2007, entitled "Unitary Sheathing Wedge," presently pending. U.S. application Ser. No. 11/950,295 is a continuation-in-part of U.S. application Ser. No. 11/933,041 filed on Oct. 31, 2007, entitled "Shrinkage Preventing Apparatus for the Sheathing of a Tendon", presently pending, and a continuation-in-part of U.S. application Ser. No. 11/933,029 filed on Oct. 31, 2007, entitled "Shrinkage Preventing Device for the Sheathing of a Tendon", presently pending. U.S. application Ser. No. 11/933,041 is a continuation-in-part of U.S. application Ser. No. 11/861,185 filed on Sep. 25, 2007, entitled "Apparatus for Preventing Shrinkage of a Sheathing Over a Tendon", presently pending. U.S. application Ser. No. 11/933,029 is a continuation-in-part of U.S. application Ser. No. 11/861,185 filed on Sep. 25, 2007, entitled "Apparatus for Preventing Shrinkage of a Sheathing Over a Tendon", presently pending.

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

INCORPORATION-BY-REFERENCE OF MATERIALS SUBMITTED ON A COMPACT DISC

Not applicable.

BACKGROUND OF THE INVENTION

1. Field of the Invention

The present invention relates to post-tension systems. More particularly, the present invention relates to anchors used in such post-tension systems. More particularly still, the present invention relates to devices used to prevent shrinkage of a sheathing that extends over the tendon within the cavity of an anchor.

2. Description of Related Art. Including Information Disclosed Under 37 CFR 1.97 and 37 CFR 1.98.

For many years, the design of concrete structures imitated the typical steel design of column, girder and beam. With technological advances in structural concrete, however, concrete design began to evolve. Concrete has the advantages of costing less than steel, of not requiring fireproofing, and of having plasticity, a quality that lends itself to free flowing or boldly massive architectural concepts. On the other hand, structural concrete, though quite capable of carrying almost any compressive load, is weak in carrying significant tensile loads. It becomes necessary, therefore, to add steel bars, called reinforcements, to concrete, thus allowing the concrete to carry the compressive forces and the steel to carry the tensile forces.

Structures of reinforced concrete maybe constructed with load-bearing walls, but this method does not use the full potentialities of the concrete. The skeleton frame, in which the floors and roofs rest directly on exterior and interior reinforced-concrete columns, has proven to be most economical and popular. Reinforced-concrete framing is seemingly a simple form of construction. First, wood or steel forms are constructed in the sizes, positions, and shapes called for by engineering and design requirements. The steel reinforcing is then placed and held in position by wires at its intersections. Devices known as chairs and spacers are used to keep the reinforcing bars apart and raised off the form work. The size and number of the steel bars depends completely upon the imposed loads and the need to transfer these loads evenly throughout the building and down to the foundation. After the reinforcing is set in place, the concrete, comprising a mixture of water, cement, sand, and stone or aggregate and having proportions calculated to produce the required strength, is set, care being taken to prevent voids or honeycombs.

One of the simplest designs in concrete frames is the beam-and-slab. This system follows ordinary steel design that uses concrete beams that are cast integrally with the floor slabs. The beam-and-slab system is often used in apartment buildings and other structures where the beams are not visually objectionable and can be hidden. The reinforcement is simple and the forms for casting can be utilized over and over for the same shape. The system, therefore, produces an economically viable structure. With the development of flat-slab construction, exposed beams can be eliminated. In this system, reinforcing bars are projected at right angles and in two directions from every column supporting flat slabs spanning twelve or fifteen feet in both directions.

Reinforced concrete reaches its highest potentialities when it is used in pre-stressed or post-tensioned members. Spans as great as five hundred feet can be attained in members as deep as three feet for roof loads. The basic principle is simple. In pre-stressing, reinforcing tendons of high tensile-strength wires are stretched to a certain determined limit and then high-strength concrete is placed around them. When the concrete has set, it holds the steel in a tight grip, preventing slippage or sagging. Post-tensioning follows the same principle, but the reinforcing tendon, usually a steel cable, is held loosely in place while the concrete is placed around it. The reinforcing tendon is then stretched by hydraulic jacks and securely anchored into place. Pre-stressing is done with individual concrete members in the shop and post-tensioning as part of the structure on the site.

In a typical tendon tensioning anchor assembly used in such post-tensioning operations, there are provided anchors for anchoring the ends of the cables suspended therebetween. In the course of tensioning the cable in a concrete structure, a hydraulic jack or the like is releasably attached to one of the exposed ends of each cable for applying a predetermined amount of tension to the tendon, which extends through the anchor. When the desired amount of tension is applied to the cable, wedges or threaded nuts, or the like, are used to capture the cable at the anchor plate and, as the jack is removed from the tendon, to prevent its relaxation and hold it in its stressed condition.

In typical post-tension systems, the tendon is received between a pair of anchors. One of the anchors is known as the "live-end" anchor, and the opposite end is known as the "dead-end" anchor. The "live-end" anchor receives the end of the tendon which is to be tensioned. The "dead-end" anchor holds the tendon in place during the tensioning operation. Under typical operations, a plurality of wedges are inserted into an interior passageway of the anchor and around the exterior surface of the tendon. The tendon is then tensioned so as to draw the wedges inwardly into the interior passageway so as establish compressive and locking contact with an exterior surface of the tendon. This dead-end anchor can then be shipped, along with the tendon, for use at the job site.

One technique for forming such dead-end anchors is to insert the end of a tendon into the cavity of the anchor, inserting wedges into the space between the tendon and the wall of the cavity and then applying a tension force onto another end of the tendon so as to draw the wedges and the end of the tendon into the cavity in interference-fit relationship therewith. This procedure is somewhat difficult because the tendon can have a considerable length and because the use of tension forces can create a somewhat unreliable connection between the wedges and the tendon. Experimentation has found that the application of compressive force onto the end of the tendon creates a better interference-fit relationship between the wedges, the end of the tendon and the wall of the cavity of the anchor.

Another technique is described in U.S. Pat. No. 6,513,287, issued on Feb. 4, 2003 to the present inventor. This patent describes a method and apparatus for forming an anchorage of a post-tension system in which a tendon is positioned within a cavity of the anchor such that an end of the tendon extends outwardly of the cavity. A plurality of wedges are mechanically inserted within the cavity between the tendon and a wall of the cavity. Pressure is applied to an end of the tendon such that the tendon and the wedges are in interference-fit relationship within the cavity. A compression mechanism has a cylindrical member and a plunger extending in a channel of the cylindrical member. The wedges are attached to the cylindrical member and the cylindrical member is moved toward the cavity such that the wedges enter a space between the tendon and the wall of the cavity. The plunger applies a compressive force to the end of the tendon when the end of the tendon is in the channel of the cylindrical member.

One of the problems with conventional dead-end anchorages is that the sheathing over the tendon has a tendency to shrink over time. The shrinkage is the result of various factors. One major factor is that the sheathing is formed over the tendon in an extrusion process. As such, the polymeric material used for the sheathing is relatively hot as it exits the extrusion process. Immediately after leaving the extrusion process, the tendon, along with the sheathing, are tightly-wound around a spool. During shipment, the tight winding of the tendon around the spool will mechanically resist any shrinking of the sheathing over the lubricated exterior of the steel cable on the interior of the sheathing. When the cable is unwound from the spool, these mechanical forces are released. As such, as the tendon is installed in an anchor, the relaxation of these mechanical forces will generally and slowly cause the sheathing to shrink over the length of the tendon. After the tendon is connected to a dead-end anchorage, the end of the sheathing will tend to shrink slowly away from the dead-end anchorage.

The problem that affects many anchorage systems is the inability to effectively prevent liquid intrusion into this area of the unsheathed portion where sheathing shrinkage has occurred. In normal practice, a liquid-tight tubular member is placed onto an end of the tendon so as to cover an unsheathed portion of the tendon. The tubular member slides onto and over the trumpet portion of the encapsulated anchor so as to be frictionally engaged with the trumpet portion of the anchor. The opposite end of the tubular member will include a seal that establishes a generally liquid-tight connection with the sheathed portion of the tendon.

In the past, various patents have issued to the present inventor relating to such corrosion-protection tubes. These patents were developed for the purpose of accommodating the natural shrinkage of the sheathing over the lubricated cable. For example, U.S. Pat. No. 5,839,235, issued on Nov. 20, 1998 to the present inventor, describes a corrosion protection tube for a post-tension anchor system. A tubular body is affixed in snap-fit engagement with the trumpet portion so as to extend outwardly from the trumpet portion in axial alignment therewith. The tubular body has a seal at an end opposite the trumpet portion so as to form a generally liquid-tight seal with an exterior surface of the tendon. The tubular body has a notch formed on an exterior surface thereof. The trumpet portion has an inwardly extending surface. The inwardly extending surface engages the notch so as to form a generally liquid-tight connection. A collar extends around the tubular body on a side of the notch so as to be in close relationship to the end of the trumpet portion.

U.S. Pat. No. 6,631,596, issued on Oct. 14, 2003 to the present inventor, teaches another corrosion protection tube for use on an anchor of a post-tension anchor system. This corrosion protection tube has a connection portion at one end and a sealing portion on an opposite end. The anchor has a trumpet portion with a notch extending therearound. The connection portion includes an inwardly extending surface for engagement with the notch of the trumpet portion. The sealing portion is in liquid-tight engagement with the sheathed portion of the tendon. Alternatively, the connection portion includes an additional inner sleeve so as to define an annular slot with the inwardly extending surface. The inner sleeve extends into the interior of the trumpet portion so that the inner sleeve and the trumpet portion are in a liquid-tight engagement.

U.S. Pat. No. 6,817,148, issued on Nov. 16, 2004 to the present inventor, describes another type of corrosion protection seal for the anchor of a post-tension anchor system. A seal member is affixed to an end of the tubular portion of the anchor opposite the anchor body. The seal member has a portion extending around the sheathed portion of the tendon in generally liquid-tight relationship therewith. The tubular portion has an interlock area extending therearound for engaging an interior surface of the seal member. The tubular portion has a length of generally greater than four inches extending outwardly of the anchor body.

U.S. Pat. No. 5,770,286, issued on Jun. 23, 1998 to the present inventor, shows a corrosion inhibitor retaining seal. This seal includes a cap having a tubular body and a surface extending across the of the tubular body. A corrosion-resistant material is contained within the interior area of the cap. This surface closes the end of the tubular body. A frangible area is formed on this surface The surface extends transverse to a longitudinal axis of the tubular body at one end of the tubular body. The frangible area has a thickness less than a thickness of a non-frangible remainder of the surface. The cap is formed of a polymeric material. The surface is formed of a deformable polymeric material such that the non-frangible portion of the surface forms a liquid-tight seal with an outer diameter of a tendon extending through the surface. The corrosion-resistant material is contained within the cap of a suitable volume so as to fill a void in the tubular member between the inner diameter of the tubular member and the outer diameter of a tendon extending therethrough.

U.S. Pat. No. 6,098,356, issued on Aug. 8, 2000 to the present inventor, shows a method and apparatus for sealing an intermediate anchorage of a post-tension system. This apparatus has a cap with an attachment section thereon. The attachment section is adapted to allow the cap to be connected to an end of the anchor body. The cap has a tubular member extending outwardly from the attachment section. The tubular member has an opening at an end opposite the attachment section. The cap also has a grease fitting formed thereon. The grease fitting is adapted so as to allow grease to be introduced into the interior passageway of the tubular member. The attachment section and the tubular member are integrally formed together of a polymeric material. A seal is affixed to the open end of the tubular member so as to form a liquid-tight seal over the sheathed portion of a tendon extending therethrough.

U.S. Pat. No. 6,381,912, issued on May 7, 2002 to the present inventor also shows a method of sealing the intermediate anchor of a post-tension system. An elastomeric seal has one end affixed to the anchor member and extending outwardly therefrom. A rigid ring member is detachably received within an opposite end of the seal. The ring member has an inner diameter greater than an outer diameter of the tendon. The opposite end of the seal is in liquid-tight compressive contact with the exterior surface of the tendon when the ring member is detached from the seal. The interior passageway of the anchor, the seal and the ring member have an inner diameter, when joined together, which is larger than the outer diameter of the tendon so as to allow the anchor member, the seal and the ring member to slide along the length of the tendon.

As can be seen, there is a great deal of technology associated with this need to accommodate the shrinkage of the sheathing over the cable of the tendon of the post-tension anchor system. Each of this technology suggests the placement of an additional tube over the polymeric encapsulation and additional materials for sealing the unsheathed portion of the tendon which extends outwardly of the anchor. In certain circumstances, these tubes are sometimes improperly installed and, at best, are simply an additional component that needs to be associated with the post-tension system. As such, it adds additional costs and can require additional labor associated with the installation of the sealing tube. As such, a need has developed so as to prevent the shrinkage of the sheathing of a tendon so as to avoid the use of such a tube with the anchors of a post-tension anchor system.

Various patents have been filed by the present inventor addressing the need to prevent the shrinkage of the sheathing of a tendon. For example, U.S. application Ser. No. 11/861,185 filed on Sep. 25, 2007, discloses an apparatus for fixing the sheathing of an end of a tendon within an anchor body of a post-tension anchor system that has an anchor body with a cavity formed therein, a tendon extending into the cavity, a fixing element engaged with the sheathing of the tendon for fixing a position of the sheathing on the tendon, and a pair of wedges in frictional engagement with the unsheathed portion of the tendon within the anchor body. The fixing element is positioned within the cavity. The fixing element can either be a wedge member interposed between the sheathing and the tendon so as to frictionally engage the tendon or a clip member engaged with the sheathing.

U.S. patent application Ser. No. 11/861,197, filed on Sep. 25, 2007, discloses a sheathing-retaining article for use with a post-tension anchorage system that has a wedge with a tendon-retaining portion and a sheathing-retaining portion. The tendon-retaining portion has a channel extending longitudinally therealong. The channel is suitable for retaining the tendon therein. The tendon-retaining portion has a tapering outer surface with a wide end at one end of the wedge and a narrow end spaced therefrom. The sheathing-retaining portion extends outwardly from the narrow end of the tendon-retaining portion. The sheathing-retaining portion engages a sheathing of a tendon extending through the channel of the wedge.

U.S. patent application Ser. No. 11/874,087, filed on Oct. 17, 2007, discloses an apparatus for preventing shrinkage of a sheathing of a tendon that has an anchor body having a cavity formed in an interior thereof, a tendon extending into the cavity, a fixing element engaged with the sheathing for fixing a position of the sheathing on the tendon, and a pair of wedges in frictional engagement with the unsheathed portion of the tendon in the cavity of the anchor body. The fixing element is positioned away from the cavity of the anchor. An encapsulation is formed over the anchor body so as to define a trumpet extending outwardly from one side of the anchor body. A clamp is engaged with the sheathed portion of the tendon within the trumpet.

U.S. patent application Ser. No. 11/933,041, filed on Oct. 31, 2007, discloses an apparatus for fixing the sheathing of an end of a tendon within an anchor body of a post-tension anchor system that has an anchor body with a cavity formed in an interior thereof, a tendon extending into the cavity that has a sheathing extending at least partially thereover and has a sheathed portion and an unsheathed portion, a pair of wedges in frictional engagement with the unsheathed portion of the tendon in the cavity of the anchor body, and at least one wedge member engaged with the sheathed portion. The wedge member has a first portion and a second portion. The first portion is of a constant thickness and has an end adjacent the pair of wedges. The second portion has a first end and a second end, the second portion being of a decreasing thickness from the first end to the second end.

U.S. patent application Ser. No. 11/933,029, filed on Oct. 31, 2007, discloses a device for fixing the sheathing of an end of a tendon within an anchor body of a post-tension anchor system that has an anchor body having a cavity formed in an interior thereof, a tendon extending into the cavity having a sheathing extending at least partially thereover and having a sheathed portion and an unsheathed portion, a pair of wedges in frictional engagement with the unsheathed portion of the tendon in the cavity of the anchor body, and at least one wedge member engaged with the sheathed portion. The wedge member has a wide end and a narrow end, the wide end being adjacent to the pair of wedges. The wedge member has a decreasing thickness from the wide end to the narrow end.

U.S. patent application Ser. No. 11/950,295, filed on Dec. 4, 2007, discloses an apparatus for fixing the sheathing of an end of a tendon within an anchor body of a post-tension anchor system that has an anchor body having a cavity formed in an interior thereof, a tendon extending into the cavity and having a sheathing extending at least partially thereover and having a sheathed portion and an unsheathed portion, a pair of wedges engaged with the unsheathed portion of the tendon in the cavity of the anchor body, and a wedge member engaged with the sheathing of the sheathed portion. The wedge member is a unitary piece having a longitudinal split extending from an end of the piece to an opposite end of the piece. The wedge member substantially encircles an interior or an exterior of the sheathing of the sheathed portion of the tendon.

U.S. patent application Ser. No. 12/100,066, filed on Apr. 9, 2008, discloses a sheathing lock that has a tubular body having an inner surface and an outer surface and a first end and a second end, a collar formed at the second end, a locking thread extending radially inwardly from the inner surface, and a longitudinal split extending from the first end to the second end. The collar has an inside and an outside. The outside has a diameter equal to a diameter of the outer surface. The inside has a diameter less than a diameter of the inner surface. The collar has a gap aligned with the longitudinal split of the tubular body. The gap is wider than the longitudinal split. The longitudinal split tapers from the second end to the first end. The locking thread extends radially inwardly so as to have an inner diameter greater than the inner diameter of the collar. The locking thread has a trapezoid cross-sectional shape.

In using the various above-identified sheathing retaining devices, it has been found that the curvature of the sheathing surrounding a tendon is inconsistent. This inconsistent curvature creates a problem for the substantially circular tubular bodies of the sheathing retaining devices because the inconsistent portions of the sheathing are not adequately held by the substantially circular devices. Thus, there is now a need for a sheathing retaining device that retains the sheathing of a tendon while accommodating for inconsistencies in the curvature of the sheathing around the tendon.

It is an object of the present invention to provide an apparatus which effectively prevents shrinkage of the sheathing at an anchor of a post-tension anchor system.

It is another object of the present invention to provide an apparatus that accommodates for the inconsistent curvature of sheathing around a tendon.

It is another object of the present invention to provide an apparatus that can be easily installed during the installation of the wedges associated with the dead-end anchorage of a post-tension anchor system.

It is another object of the present invention to provide an apparatus which effectively engages the sheathing at the anchor so as to resist shrinkage forces associated with the sheathing.

It is still another object of the present invention to provide an apparatus which resists the shrinkage of the sheathing of a tendon of a post-tension anchor system which is easy to install, relatively inexpensive and easy to manufacture.

These and other objects and advantages of the present invention will become apparent from a reading of the attached specification and appended claims.

BRIEF SUMMARY OF THE INVENTION

The present invention is an article for engaging a sheathing of a sheathed portion of a tendon comprising a tubular body having an inner surface and an outer surface and a first end and a second end, a plurality of fins extending radially outwardly from the outer surface, a longitudinal split extending through a wall of the tubular body and extending from the first end to the second end, a plurality of locking ribs extending radially inwardly from the inner surface of the tubular body, and a collar formed adjacent the second end of the tubular body.

The collar has an inside and an outside. The outside has a diameter equal to a diameter of the outer surface. The inside has a diameter less than a diameter of the inner surface. The collar has a gap aligned with the longitudinal split. The gap has a width equal to a width of the longitudinal split.

The plurality of locking ribs extend radially inwardly so as to have an inner diameter greater than the diameter of the inside of the collar. Each of the plurality of locking ribs extends parallel to an other of the plurality of locking ribs.

Each of the plurality of fins extends parallel to an other of the plurality of fins. The plurality of fins are equally spaced along the outer surface of the tubular body. Each of the plurality of fins has a height increasing from the first end to the second end of the tubular body.

The tubular body and the collar and the plurality of locking ribs and the plurality of fins are integrally formed of a polymeric material.

The present invention is an apparatus comprising an anchor body having a cavity formed in an interior thereof, a tendon extending into the cavity and having a sheathing extending at least partially thereover so as to have a sheathed portion and an unsheathed portion, a pair of wedges in frictional engagement with the unsheathed portion of the tendon in the cavity of the anchor body, and a sheathing retaining clip engaged with the sheathed portion of the tendon in the cavity of the anchor body. The sheathing retaining clip is the same as the sheathing retaining clip described hereinabove. The plurality of fins are compressively interposed between a wall of the cavity and the outer surface of the tubular body. The plurality of locking ribs compressively engage the sheathing of the tendon so as to retain the sheathing within the cavity of the anchor body. The collar abuts an end of the sheathing within the cavity of the anchor body.

DETAILED DESCRIPTION OF THE INVENTION

Figure 1:
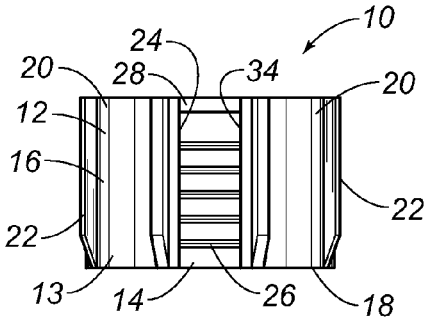
FIG. 1 shows a side elevational view of the preferred embodiment of the sheathing retaining clip of the present invention.

Referring to FIG. 1, there is shown a side elevational view of the sheathing retaining clip 10 of the present invention. The sheathing retaining clip 10 has a tubular body 12 that has an inner surface 14, an outer surface 16, a first end 18, and a second end 20. The tubular body 12 is substantially circular in shape. A plurality of fins 22 extend radially outwardly from the outer surface 16 of the tubular body 12. The continuous wall 13 of the tubular body 12 is broken by a longitudinal split 24 that extends from the first end 18 to the second end 20 of the tubular body 12. As can be seen, the fins 22 extend from the first end 18 to the second end 20 of the tubular body 12. Each of the fins 22 has a height that increases from the first end 18 to the second end 20 of the tubular body 12 or, at least, has a portion that increases in height from the first end 18. Locking ribs 26 are located on the inner surface 14 of the tubular body 12. The locking ribs 26 extend radially inwardly from the inner surface 14. The locking ribs 26 are parallel to one another. Each locking rib 26 extends around the circumference of the inner surface 14 of the tubular body 12. The locking ribs 26 are equally spaced on the inner surface 14 of the tubular body 12. The ends 22 are equally spaced on the outer surface 16 of the tubular body 12. A collar 28 is formed adjacent the second end 20 of the tubular body 12. The collar 28 has a gap 34 that has a width that is the same as the width of the longitudinal split 24. The tubular body 12 and the ends 22 and the locking ribs 26 and the collar 28 are integrally formed of a polymeric material.

Figure 2:
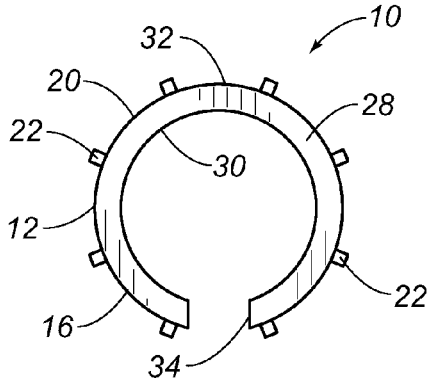
FIG. 2 shows an end elevational view of the second end of the sheathing retaining clip of the present invention.

Referring to FIG. 2, there is shown an end elevational view of the second end 20 of the sheathing retaining clip 10 of the present invention. The collar 28 is formed adjacent the second end 20. The collar 28 has an inside 30 and an outside 32. The outside 32 of the collar 28 has diameter equal to a diameter of the outer surface 16 of the tubular body 12. The fins 22 can be seen as extending radially outwardly from the outer surface 16 for the tubular body 12. As can be seen, the fins 22 are equally spaced around the perimeter of the outer surface 16 of the tubular body 12. The fins 22 are shown to have a rectangular cross-sectional shape. The present invention contemplates that the fins 22 can be of any cross-sectional shape that serves the purpose of compensating for inconsistencies in the curvature of the sheathing of a tendon. The collar 28 is substantially circular in shape, and the circularity of the collar is interrupted by gap 34.

Figure 3:
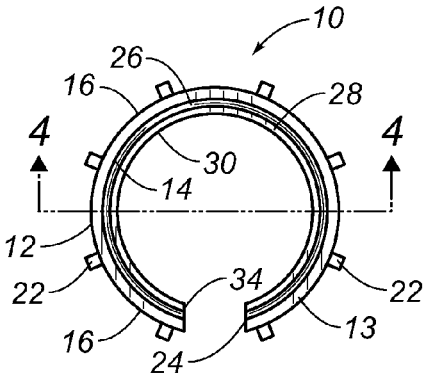
FIG. 3 shows an end elevational view of the first end of the sheathing retaining clip of the present invention.

Referring to FIG. 3, there is shown an end elevational view of the first end 18 of the sheathing retaining clip 10 of the present invention. The locking ribs 26 are shown as extending radially inwardly from the inner surface 14 of the tubular body 12. The inside 30 of the collar 28 extends radially inwardly further than the locking ribs 26. That is, the inside 30 of the collar 28 has a diameter smaller than a diameter of the locking ribs 26. The tubular body 12 is substantially circular. The circularity of the tubular body 12 is interrupted by the longitudinal split 24. Thus, the circularity of the collar 28 and the tubular body 12 is interrupted by the gap 34 and the longitudinal split 24, respectively. The width of the gap 34 and the width of the longitudinal split 24 are the same. The gap 34 and the longitudinal split 24 becomes smaller when the sheathing retaining clip 10 is inserted into a cavity of an anchor. The gap 34 and the longitudinal split 24 allow the sheathing retaining clip 10 to be easily placed around the sheathing of a tendon.

Figure 4:
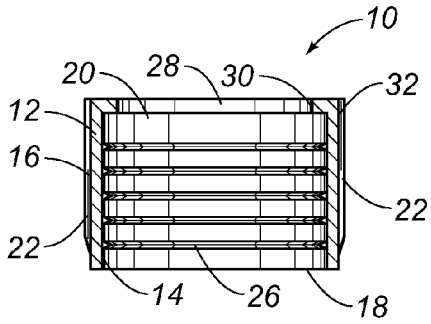
FIG. 4 shows a cross-sectional view of the sheathing retaining clip of the present invention taken along sight line 4-4 of FIG. 3.

Referring to FIG. 4, there is shown a cross-sectional view of the sheathing retaining clip 10 of the present invention taken along sight line 4—4 of FIG. 3. The fins 22 extend radially outwardly from the outer surface 16 of the tubular body 12. The collar 28 is formed at the second end 20 of the tubular body 12. The inside 30 of the collar 28 extends radially inwardly further than the locking ribs 26. The outside 32 of the collar 28 has a diameter equal to the diameter of the outer surface 16 of the tubular body 12. The locking ribs 26 extend radially inwardly much less than the collar 28. The collar 28 forms a surface abutting the sheathing of a tendon within the cavity of an anchor. The collar 28 helps support the sheathing retaining clip 10 around the sheathing before the sheathing retaining clip 10 is compressed around the sheathing of a tendon. The locking ribs 26 bite into the sheathing of the tendon once the sheathing retaining clip 10 is compressed around the sheathing of a tendon. The fins 22 can again be seen as increasing in height from the first end 18 to the second end 20 of the tubular body 12. As can be seen, the height of the fins 22 increases dramatically near the first end 18 while remaining relatively constant towards the second end 20. The present invention contemplates that the height of the fins 22 can taper from the second end 20 to the first end 18 at any rate suitable for the purpose for accommodating inconsistencies in the curvature of the sheathing of a tendon. When installed, the fins 22 compress so as to accommodate any inconsistencies in the sheathing of a tendon received in the tubular body 12.

Figure 5:
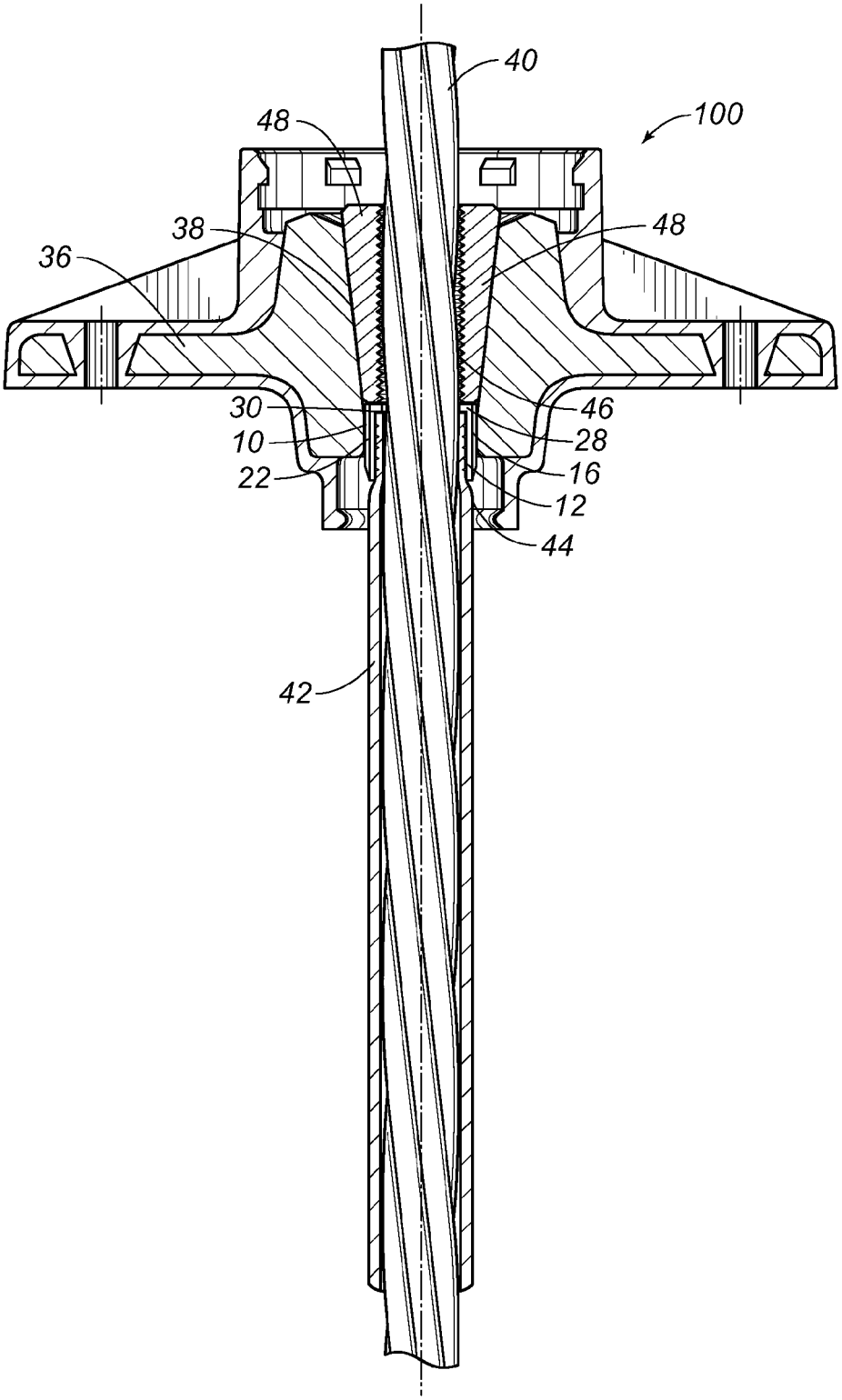
FIG. 5 shows a cross-sectional view of the apparatus of the present invention.

Referring to FIG. 5, there is shown a cross-sectional view of the apparatus 100 of the present invention. The apparatus 100 has an anchor body 36 that has a cavity 38 formed in an interior thereof. A tendon 40 extends into the cavity 38. The tendon 40 has a sheathing 42. The sheathing 42 extends partially within the cavity 38. Thus, the tendon 40 has an unsheathed portion 46 within the cavity 38 and a sheathed portion 44 within the cavity 38. A pair of wedges 48 are in frictional engagement with the unsheathed portion 46 of the tendon 40 and the cavity 38 of the anchor body 36.

The sheathing retaining clip 10 is shown as compressed around the sheathed portion 44 of the sheathing 42 of the tendon 40. Although not seen in FIG. 5, the gap 34 and the longitudinal split 24 of the sheathing retaining clip 10 are substantially closed when compressed within the cavity 38 of the anchor body 36. The locking ribs 26 bite into the sheathed portion 44 of the sheathing 42 within the cavity 38 of anchor body 36. The fins 22 that are equally spaced around the outer surface 16 of the tubular body 12. The inside 30 of the collar 28 can be seen as providing a ledge that abuts the end of the sheathed portion 44 of the sheathing 42 within the cavity 38 of the anchor body 36. The collar 28 resides in the cavity 38 between the sheathing 42 of the sheathed portion 44 and the wedges 48.

The foregoing disclosure and description of the invention is illustrative and explanatory thereof. Various changes in the details of the illustrated construction can be made within the scope of the appended claims without departing from the true spirit of the invention. The present invention should only be limited by the following claims and their legal equivalents.

I claim:

1. An article for engaging a sheathing of sheathed portion of a tendon comprising:

a tubular body having an inner surface, an outer surface, a first end and a second end;

a plurality of fins extending radially outwardly from said outer surface, each of said plurality of fins being radially spaced from an adjacent fin, each of said plurality of fins defining a outer linear edge extending from said first end to said second end of said tubular body; and a longitudinal split extending through a wall of said tubular body and extending from said first end to said second end.

2. The article of claim 1, further comprising:

a plurality of locking ribs extending radially inwardly from said inner surface of said tubular body; and a collar formed adjacent said second end of said tubular body.

3. The article of claim 2, said collar having an inside and an outside, said outside having a diameter equal to a diameter of said outer surface, said inside having a diameter less than a diameter of said inner surface.

4. The article of claim 3, said collar having a gap aligned with said longitudinal split, said gap having a width equal to a width of said longitudinal split.

5. The article of claim 3, said plurality of locking ribs extending radially inwardly so as to have an inner diameter greater than said diameter of said inside of said collar.

6. The article of claim 5, each of said plurality of locking ribs extending parallel to another of said plurality of locking ribs.

7. The article of claim 1, said linear edge of one of said plurality of fins extending parallel to the liner edge of another of said plurality of fins.

8. The article of claim 7, said plurality of fins being equally radially spaced around said outer surface of said tubular body.

9. The article of claim 8, each of said plurality of fins being tapered so as to have a height increasing from said first end to said second end of said tubular body.

10. The article of claim 2, said tubular body and said collar and said plurality of locking ribs and said plurality of fins being integrally formed of a polymeric material.

11. An apparatus comprising:

an anchor body having a cavity formed in an interior thereof;

a tendon extending into said cavity, said tendon having a sheathing extending at least partially thereover, said tendon having a sheathed portion and an unsheathed portion;

a pair of wedges in frictional engagement with said unsheathed portion of said tendon in said cavity of said anchor body; and a sheathing retaining clip engaged with said sheathed portion of said tendon in said cavity of said anchor body, said sheathing retaining clip comprising:

a tubular body having an inner surface, an outer surface, a first end, and a second end;

a plurality of fins extending radially outwardly in spaced relation to each other from said outer surface;

a longitudinal split extending through a wall of said tubular body and extending from said first end to said second end; and a collar formed adjacent said second end of said tubular body, said collar abutting an end of said sheathing.

12. The apparatus of claim 11, said sheathing retaining clip further comprising:

a plurality of locking ribs extending radially inwardly from said inner surface of said tubular body.

13. The apparatus of claim 12, each of said plurality of locking ribs extending parallel to another of said plurality of locking ribs.

14. The apparatus of claim 11, each of said plurality of fins having a linear edge extending parallel a linear edge of another of said plurality of fins.

15. The apparatus of claim 14, said plurality of fins being equally radially spaced around said outer surface of said tubular body.

16. The apparatus of claim 15, each of said plurality of fins having a height increasing from said first end to said second end of said tubular body.

17. The apparatus of claim 16, each of said plurality of fins having a first portion tapering outwardly from said first end and a second portion extending in generally parallel relationship to said outer surface of said tubular body.

18. The apparatus of claim 11, said plurality of fins being compressively interposed between a wall of said cavity and said outer surface of said tubular body.

19. The apparatus of claim 12, said plurality of locking ribs being compressively engaged with said sheathing of said tendon so as to bite into said sheathing and to retain said sheathing within said cavity of said anchor body.

* * * * *